US005244773A

United States Patent [19]

Muramatsu et al.

[11] Patent Number: 5,244,773

[45] Date of Patent: Sep. 14, 1993

[54] SILVER HALIDE PHOTOGRAPHIC LIGHT SENSITIVE MATERIAL

[75] Inventors: Yasuhiko Muramatsu, Hachioji; Takeshi Sampei, Hino, both of Japan

[73] Assignee: Konica Corporation, Tokyo, Japan

[21] Appl. No.: 825,572

[22] Filed: Jan. 24, 1992

[30] Foreign Application Priority Data

Jan. 29, 1991 [JP] Japan ..... 3-026783

[51] Int. Cl.[5] ..... G03C 1/06

[52] U.S. Cl. ..... 430/264; 430/527; 430/528; 430/529; 430/598

[58] Field of Search ..... 430/264, 527, 528, 529, 430/598

[56] References Cited

U.S. PATENT DOCUMENTS

| | | | |
|---|---|---|---|
| 4,269,929 | 5/1981 | Nothnagle | 430/264 |
| 4,416,963 | 11/1983 | Takimoto et al. | 430/527 |
| 4,929,535 | 5/1990 | Takahashi et al. | 430/264 |
| 4,975,354 | 12/1990 | Machonkin et al. | 430/264 |
| 4,987,052 | 1/1991 | Hirano et al. | 430/264 |
| 4,999,276 | 3/1991 | Kuwabara et al. | 430/264 |
| 5,098,822 | 3/1992 | Tachibana et al. | 430/527 |
| 5,102,779 | 4/1992 | Kojima et al. | 430/264 |
| 5,135,843 | 8/1992 | Takamuki et al. | 430/527 |

FOREIGN PATENT DOCUMENTS

| | | | |
|---|---|---|---|
| 0330109 | 8/1989 | European Pat. Off. | 430/264 |
| 0409665 | 1/1991 | European Pat. Off. | 430/527 |
| 0059649 | 3/1991 | Japan | 430/527 |

*Primary Examiner*—Charles L. Bowers, Jr.
*Assistant Examiner*—Thomas R. Neville
*Attorney, Agent, or Firm*—Finnegan, Henderson, Farabow, Garrett & Dunner

[57] ABSTRACT

A silver halide photographic light sensitive material having high contrast photographic characteristics and excellent antistatic properties is provided by incorporating a hydrazine compound represented by formula 1 or 2 and a nucleation-promoting compound selected from the group consisting of amine compounds and quaternary onium salts; and by coating an electrically conductive layer on a support.

formula 1 formula 2

9 Claims, No Drawings

SILVER HALIDE PHOTOGRAPHIC LIGHT SENSITIVE MATERIAL

BACKGROUND OF THE INVENTION

This invention relates to a photographic light sensitive material comprising a support bearing a silver halide emulsion layer thereon and particularly to a silver halide photographic light sensitive material capable of providing a high contrast.

A photographic plate-making process include a step of converting an original document having continuous tones into a halftone-dot image. In this step, an infectious development technique has been used as a technique capable of providing an image having a superhard contrast.

A lithographic type silver halide photographic light sensitive material subject to an infectious development is comprised of, for example, a silver chlorobromide emulsion having an average grain size of 0.2 μm, a relatively narrow grain size distribution, a uniform grain configuration and a relatively high silver chloride content (at least not less than 50 mol %). When processing the lithographic type silver halide photographic light sensitive material with an alkaline hydroquinone developer having a relatively low sulfite ion concentration, that is the so-called lithographic type developer, an image having a high contrast, a high sharpness and a high resolving power can be obtained.

However, the preservability of the above-mentioned lithographic type developers are deteriorated because this type of developers are liable to be air-oxidized. It is, therefore, very hard to keep the development quality in making repetition use of this type of developers.

On the other hand, there are known techniques for rapidly providing high contrast images without making use of any lithographic type developer mentioned above. In the techniques, a hydrazine derivative is contained in a silver halide photographic light sensitive material, as seen in Japanese Patent Publication Open to Public Inspection—hereinafter referred to as JP OPI Publication- No. 56-106244/1981, for example.

According to the above-mentioned techniques, a high-contrast image can be obtained by processing a light sensitive material with a developer excellent in preservability and capable of performing a rapid processing. In the techniques, however, a developer having a pH of not lower than pH 11.0 has been required for satisfactorily displaying the high-contrast rendering property of the hydrazine derivatives. In the high pH developers such as those having a pH of not lower than 11.0 mentioned above, the developing agents thereof are liable to be oxidized when the developers are exposed to the air, so that a ultrahigh contrast image may not be provided by the above-mentioned air-oxidation, though this type of developer is relatively stable as compared to the foregoing lithographic developers.

With the purpose of remedying the above-mentioned defects, JP OPI Publication No. 63-29751/1988 and European Patent No. 333,435 disclose the silver halide photographic light sensitive materials each containing a contrast-promoting agent capable of increasing the contrast of the light sensitive material even when making use of a relatively low-pH developer.

It has, however, been the present situation that, when processing a silver halide photographic light sensitive material containing such a contrast-promoting agent as mentioned above with a developer having a pH lower than 11.0, the contrast of the light sensitive material has been provided as yet not quite satisfactory, so that any satisfactory halftone dot quality has not been available.

In a silver halide photographic light sensitive material, a support such as those made of polyethylene terephthalate has commonly been used. However, such a support has a problem that an electrostatic charge is liable to generate particularly in the low humidity conditions such as in winter time.

If a light sensitive material is electrostatically charged, the discharge thereof produces the so-called static-marks or pin-holes produced by the adhesion of foreign matters such as dusts to the light sensitive material, so that the quality is seriously deteriorated and there may be some instances where the processing efficiency may be lowered because of remedying the quality deterioration. Therefore, the improvements of the above-mentioned problems have been strongly demanded.

SUMMARY OF THE INVENTION

It is an object of the invention to provide a silver halide photographic light sensitive material capable of providing high-contrast photographic characteristics even when processing it with a developer having a pH lower than pH 11, excellent in antistatic characteristics and, particularly, less in pin-hole production.

The above-mentioned object of the invention can be achieved with each of the following constitution of the invention.

(1) A silver halide photographic light sensitive material comprising a support bearing thereon at least one silver halide emulsion layer, wherein the silver halide emulsion layer and/or the layer adjacent thereto contain at least a hydrazine derivative represented by the following formulas 1 and 2 and at least a nucleation-promoting compound selected from the group consisting of amine compounds and quaternary onium salts, and an conducting layer is interposed between the silver halide emulsion layer and the support and/or arranged onto the support side opposite to the emulsion layer.

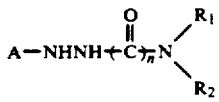

formula 1

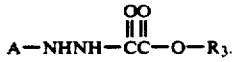

formula 2 wherein A represents an aryl group or a heterocyclic group containing at least one sulfur or oxygen atom; n is an integer of 1 or 2, provided, when n is 1, $R_1$ and $R_2$ represent each a hydrogen atom, an alkyl group, an alkenyl group, an alkynyl group, an aryl group, a heterocyclic group, a hydroxy group, an alkoxy group, an alkenyloxy group, an alkynyloxy group, an aryloxy group or a heterocyclic-oxy group and $R_1$ and $R_2$ are also allowed to form a ring in association with a nitrogen atom; when n is 2, $R_1$ and $R_2$ represent each a hydrogen atom, an alkyl group, an alkenyl group, an alkynyl group, an aryl group, a saturated or unsaturated heterocyclic group, a hydroxy group, an alkoxy group, an alkenyloxy group, an alkynyloxy group, an aryloxy group or a heterocyclic-oxy group, provided, when n is 2, at least one of $R_1$ and $R_2$ represents an alkenyl group, an alkynyl group, a saturated heterocyclic group, a hydroxy group, an alkoxy group, an alkenyloxy group, an alkynyloxy group, an aryloxy group or a heterocyclic-oxy group; $R_3$ represents an alkynyl group or a saturated heterocyclic group; and, the compounds represented by formula 1 or 2 include those in which at least either one of H of —NHNH— of the formulas is substituted with a substituent.

(2) A silver halide photographic light sensitive material wherein the conducting layer mentioned in the above paragraph (1) contains water-soluble conducting polymer particles, hydrophobic polymer particles and a hardener; and (3) A silver halide photographic light sensitive material wherein the conducting layer mentioned in the above paragraph (1) or (2) contains a metal oxide.

In the preferable embodiments of the invention, the above-mentioned conducting layer is desirable to contain water-soluble conducting polymer particles, hydrophobic polymer particles and a hardener.

DETAILED DESCRIPTION OF THE INVENTION

The above-given formula 1 or 2 will be more detailed. A represents an aryl group or a heterocyclic group containing at least one sulfur or oxygen atom.

$R_1$ and $R_2$ represent each a hydrogen atom, an alkyl group, an alkenyl group, an alkynyl group, an aryl group, a heterocyclic group, a hydroxy group, an alkoxy group, an alkenyloxy group, an alkynyloxy group, an aryloxy group or a heterocyclic-oxy group, provided, when n is 1, $R_1$ and $R_2$ are allowed to form a ring;

provided, when n is 2, at least one of $R_1$ and $R_2$ represents an alkenyl group, an alkyl group, a saturated heterocyclic group, a hydroxy group, an alkoxy group, an alkenyloxy group, an alkinyloxy group, an aryloxy group or a heterocyclic-oxy group.

The examples of the alkynyl groups and the saturated heterocyclic groups each represented by $R_3$ include such as those given above.

A variety of substituents may be introduced into the aryl groups or the heterocyclic groups each containing at least one sulfur or oxygen atom, each of which is represented by A. Among the substituents, a sulfonamido group, an alkylamino group and an alkylideneamino group are preferred.

A represented in each of the formulas is preferable to contain at least one of non-diffusible groups or groups for promoting adsorption on silver halide. The non-diffusible groups include, preferably, a ballast group commonly used in an immobile photographic additive such as a coupler. The above-mentioned ballast groups are relatively, photographically innert, each having not less than 8 carbon atoms, which can be selected from the group consisting of an alkyl group, an alkoxy group, a phenyl group, an alkylphenyl group, a phenoxy group, an alkylphenoxy group and so forth.

The adsorption-promoting groups include, for example, those given in U.S. Pat. No. 4,385,108, such as a thiourea group, a thiourethane group, a heterocyclic thioamido group, a mercaptoheterocyclic group and a triazole group. H of —NHNH— given in formulas 1 and 2, that is a hydrogen atom of a hydrozine group, is allowed to be substituted with a substituent such as a sufonyl group, an acyl group and an oxalyl group and they also include, for example, the compounds represented by formulas 1 and 2.

The compounds more desirable in the invention include, for example, the compounds represented by formula 1 in the case of n=2 and the compounds represented by formula 1 in the case of n=2. In the compounds represented by formula 1 in the case of n=2, $R_1$ and $R_2$ represent each a hydrogen atom, an alkyl group, an alkenyl group, an alkynyl group, an aryl group, a saturated or unsaturated heterocyclic group, a hydroxy group or an alkoxy group and, in the more desirable compounds, at least one of $R_1$ and $R_2$ represents an alkenyl group, an alkynyl group, a saturated heterocyclic group, a hydroxy group or a alkoxy group.

The detailed descriptions of each of the above-described substituents and the typical compounds represented by the foregoing formulas 1 and 2 are given in JP OPI Publication No. 2-841/1990 and Japanese Patent Application No. 2-234203/1990. The particularly desirable compounds are given below and the typical compounds represented by formulas 1 and 2, which are applicable to the invention, shall not be limited thereto.

Compound

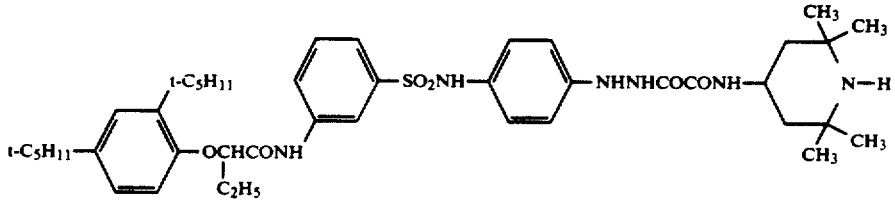

(1)

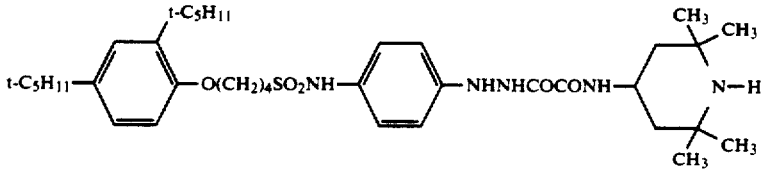

(2)

-continued

Compound (3)

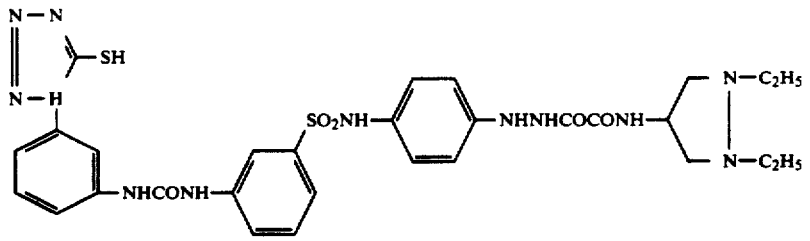

(4)

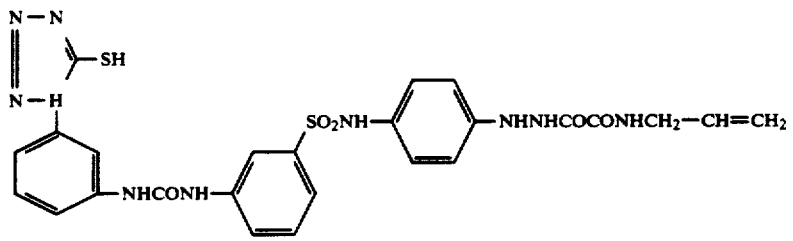

(5)

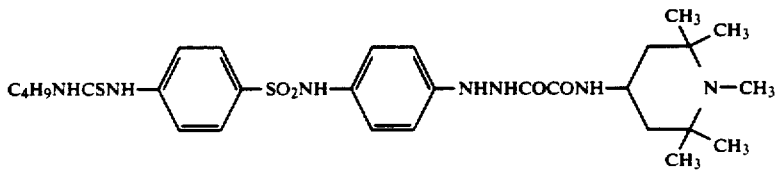

(6)

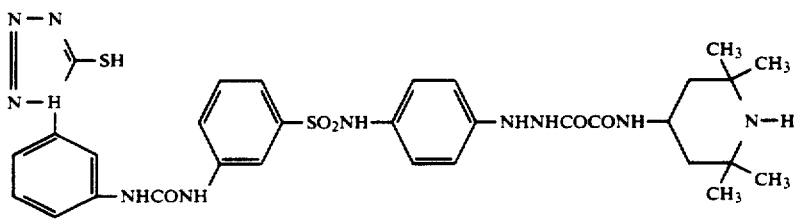

(7)

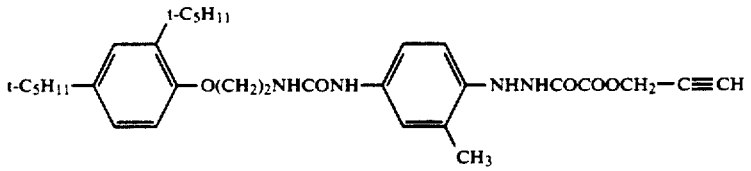

(8)

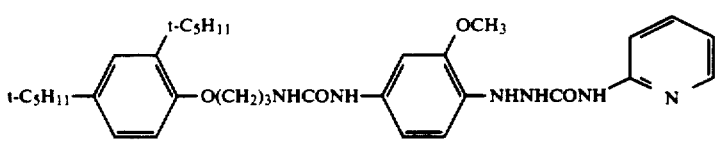

(9)

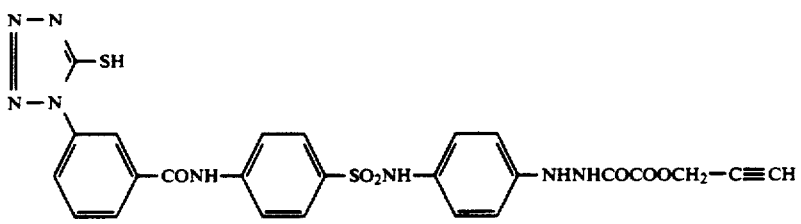

In the nucleation-promoting compounds jointly used with the compounds represented by formulas 1 and 2 in the invention, the amine compounds and quaternary onium compounds include, for example, those represented by the following formulas 3 through 12, The typical compounds represented by formulas 3 through 12 are detailed in JP OPI No. 2-841/1990 and Japanese Patent Application No. 2-234203/1990.

$R_1—N(R_2)R_3$ Formula 3 wherein $R_1$, $R_2$ and $R_3$ represent each a hydrogen atom or a substituent, provided, $R_1$, $R_2$ and $R_3$ are allowed to couple to each other so as to form a ring. The substituents represented by $R_1$, $R_2$ and $R_3$ include, for example, an alkyl group, an alkenyl group, an alkinyl group, an aryl group and a heterocyclic group. $R_1$, $R_2$ and $R_3$ are allowed to couple to each other so as to form a ring. The groups represented by $R_1$, $R_2$ and $R_3$ are each also allowed to be substituted with a substituent. $R_1$, $R_2$ and $R_3$ are preferable to represent a hydrogen atom and an alkyl group.

The typical examples of the compounds represented by formula 3 may be given as follows.

Compound 3-1

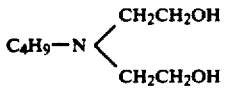

3-2

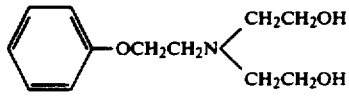

3-3

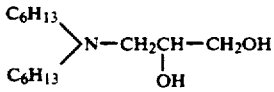

Formula 4

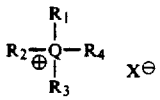

wherein Q represents an N or P atom; $R_1$, $R_2$, $R_3$ and $R_4$ represent each a hydrogen atom or a substitutable group; and $X^{\ominus}$ represents an anion, provided, $R_1$, $R_2$, $R_3$ and $R_4$ are each allowed to couple to each other so as to form a ring, and the substitutable groups represented by $R_1$, $R_2$, $R_3$ and $R_4$ include, for example, those described in the case of $R_1$, $R_2$, $R_3$ represented by formula 3. The rings which $R_1$, $R_2$, $R_3$ and $R_4$ are capable of forming them include, for example the same rings as described in the case of $R_1$, $R_2$, $R_3$ represented by formula 3. The anions represented by $X^{\ominus}$ include, for example, inorganic and organic anions such as a halide ion, a sulfuric acid ion, a nitric acid ion, acetic acid ion and paratoluene sulfonic acid ion.

The typical examples of the preferable compounds represented by formula 4 are given below.

Compound 4-1

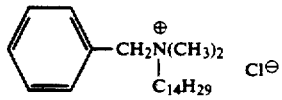

4-2

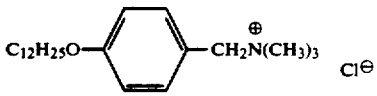

4-3

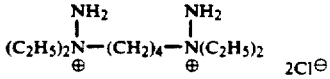

$R_1(R_2)N—A—Y—R_3$ Formula 5 wherein $R_1$ and $R_2$ represent each an alkyl group, provided $R_1$ and $R_2$ may be coupled to each other so as to form a ring; $R_3$ represents an alkyl group, an aryl group or a heterocyclic group; A represents an alkylene group;

Y represents a group of —$CONR_4$—, —$OCONR_4$—, —$NR_4CONR_4$—, —$NR_4COO$—, —COO—, —OCO—, —CO—, —OCOO—, —$NR_4CO$—, -$S02NR_4$—, —$NR_4SO_2$—, —$NR_4SO_2NR_4$—, —$SO_2$—, —S—, —O—, —$NR_4$— or —N═; and $R_4$ represents a hydrogen atom or an alkyl group;

the alkyl groups represented by $R_1$ and $R_2$ include, for example, the same alkyl groups as represented by $R_1$, $R_2$ and $R_3$ denoted in formula 3, and the rings formed thereby include the same rings as in the same;

The alkyl groups, aryl groups and heterocyclic groups represented by $R_3$ include the same as in the alkyl groups, aryl groups and heterocyclic groups represented by $R_1$, $R_2$ and $R_3$ denoted in formula 3. The groups represented by A also include those substituted. The preferable alkyl groups represented by $R_4$ include, for example, a lower alkyl or aralkyl group (such as a benzyl group) having 1 to 5 carbon atoms.]

The typical examples of the preferable compounds represented by formula 5 may be given as follows.

Compound 5-1

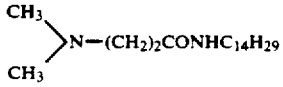

5-2

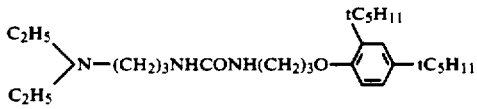

5-3

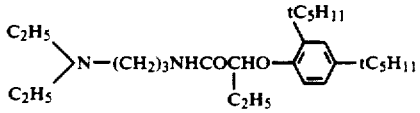

$R_1(R_2(N—E$ Formula 6 wherein $R_1$ and $R_2$ represents each a hydrogen atom or an alkyl group, an alkenyl group, an alkynyl group, an aryl group or a heterocyclic group, provided, $R_1$, $R_2$ and E are allowed to form a ring;

E represents a group containing at least one of the groups represented by the following group 1;

$\leftarrow CH_2CH_2O \rightarrow_n$ Group 1 n is an integer of not less than 2; and the alkyl group, an alkenyl group, an alkynyl group, an aryl group and a heterocyclic group each represented by $R_1$ and $R_2$ and the rings formed by $R_1$, $R_2$ and E include the same as those represented by $R_1$, $R_2$ and $R_3$ denoted in formula 3 of which have been described before.

The typical examples of the preferable compounds represented by formula 6 are given below.

Compound 6-1

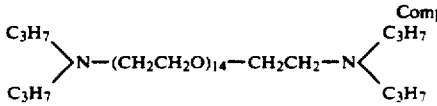

-continued 6-2

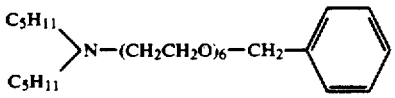

6-3

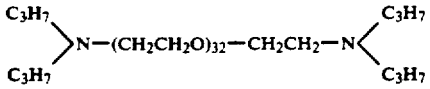

$R_1(R_2(N—L—R_3$ Formula 7 wherein $R_1$, $R_2$ and $R_3$ represent each an alkyl group, an alkynyl group, an aryl group and a heterocyclic group, provided, at least one of $R_1$, $R_2$ and $R_3$ represents an alkenyl group or an alkynyl group or at least one of $R_1$ and $R_2$ represents an aryl group or a heterocyclic group and $R_1$ and $R_2$, L and $R_3$ are allowed to form a ring; and L represents a linking group;

The alkyl group, alkenyl group, alkynyl group, aryl group and heterocyclic group each represented by $R_1$, $R_2$ and $R_3$ include the same groups given by $R_1$, $R_2$ and $R_3$ denoted in formula 3; and the rings formed by $R_1$ and $R_2$, L and $R_3$ include, for example, heterocyclic rings such as those of piperidine, morpholine and pyrrolidine;

The linking groups represented by L include, for example, —A—Y— given in formula 5.

The typical examples of the preferable compounds represented by formula 7 are given below.

Compound 7-1

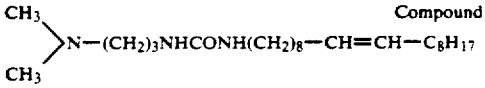

7-2

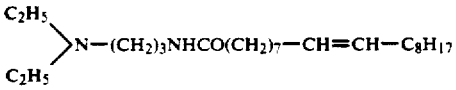

7-3

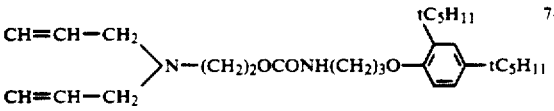

$R_1(R_2)N—N(R_3)—(L)_m—R_4$ Formula 8 wherein $R_1$, $R_2$ and $R_4$ represent each an alkyl group, an alkenyl group, an alkynyl group, an aryl group and a heterocyclic group; $R_3$ represents a hydrogen atom or a substitutable group;

L represents a linking group; n is an integer of 0 or 1; $R_1$, $R_2$, $R_3$ and $R_4$ are allowed to couple each other so as to form a ring; and the alkyl group, alkenyl group, alkynyl group, aryl group and heterocyclic group each represented by $R_1$, $R_2$, $R_3$ and $R_4$ include the same groups represented by $R_1$, $R_2$ and $R_3$ denoted in formula 3 described before;

Among the groups represented by $R_3$, the substitutable groups include, for example, the same groups given above such as an alkyl group, an alkenyl group, an alkynyl group, an aryl group and a heterocyclic group;

L represents a linking group such as the groups of —CO—, —COO—, —CONR$_5$—, —SO$_2$— or —SO$_2$N-R$_5$—;

$R_5$ represents a hydrogen atom or a substitutable group; and the rings formed by $R_1$, $R_2$, $R_3$, L and $R_4$ include, for example, heterocyclic rings such as those of piperidine or morpholine.

The typical examples of the preferable compounds represented by formula 8 are given below.

Compound 8-1

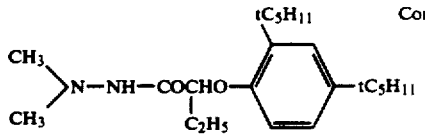

8-2

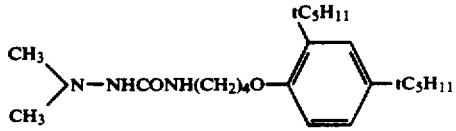

8-3

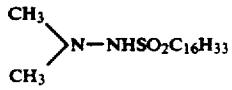

8-4

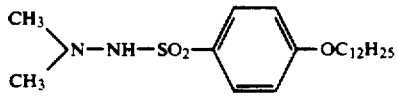

Formula 9

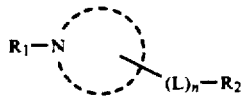

wherein $R_1$ represents a hydrogen atom or a substitutable group; $R_2$ represents an alkyl group, an alkenyl group, an alkynyl group, an aryl group or a heterocyclic group; and L represents a linking group;

The following nucleus 1 represents a nitrogen-containing heterocyclic ring.

Nucleus 1

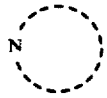

n is an integer of 0 or 1;

$R_1$ is allowed to form a ring in association with nucleus 1; and the alkyl group, alkenyl group, alkynyl group, aryl group or heterocyclic group each represented by $R_2$ include the same groups represented by $R_1$, $R_2$ and $R_3$ denoted in formula 1 described before;

Among the groups represented by $R_1$, the substituents include, for example, the same groups represented by the above-described $R_2$; and The heterocyclic rings represented by nucleus 1 and the heterocyclic rings formed by $R_1$ and nucleus 1 include, for example, the heterocyclic rings such as those of quinuclidine, piperidine or pyrazolidine.

The typical examples of the preferable compounds.

Compound 9-1

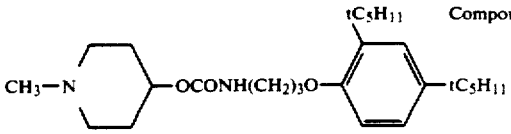

-continued 9-2

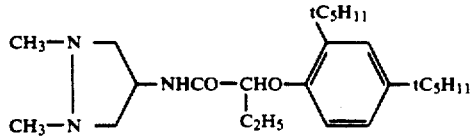

9-3

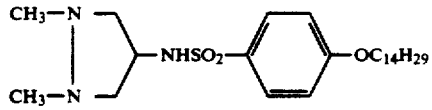

$R_1(R_2)N-N(R_3)-R_4$ Formula 10 wherein $R_1$ and $R_2$ represent each an alkyl group, an alkenyl group, an alkynyl group, an aryl group or a heterocyclic group; and $R_3$ represents a hydrogen atom or a substitutable group;

$R_4$ represents a group containing at least one of the groups represented by the following groups 2.

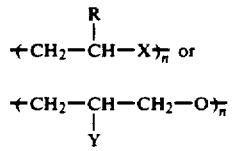

Group 2 wherein R represents a hydrogen atom or an alkyl group; X represents O, S or NH group; Y represents a hydrogen atom or OH group; and n is an integer of not less than 2;

$R_1$, $R_2$, $R_3$ and $R_4$ are allowed to couple to each other so as to form a ring; and the alkyl group, alkenyl group, alkynyl group, aryl group or heterocyclic group each represented by $R_1$ and $R_2$ include the same groups represented by $R_1$, $R_2$ and $R_3$ denoted in formula 3 described before;

Among the groups represented by $R_3$, the substituents include, for example, an alkyl group, an alkenyl group, an alkinyl group, an aryl group, a heterocyclic group, an acyl group, a sulfonyl group, an oxycarbonyl group and a carbamoyl group;

Among the groups represented by $R_3$, the alkyl group, alkenyl group, alkinyl group, aryl group and heterocyclic group include the same groups as those represented by $R_1$, $R_2$ and $R_3$ denoted in the foregoing formula 3;

Besides the above, an acyl group, a sulfonyl group, an oxycarbonyl group and a carbamoyl group may also be included therein;

The rings formed by $R_1$, $R_2$, $R_3$ and $R_4$ include the rings of piperidine or morpholinone; and Among the groups represented by R, a methyl group is preferred to serve as the alkyl group.

The typical examples of the compounds represented by formula 10 may be given as follows.

Compound 10-1

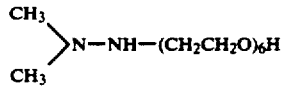

10-2

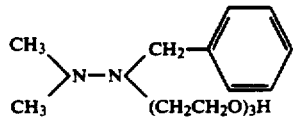

10-3

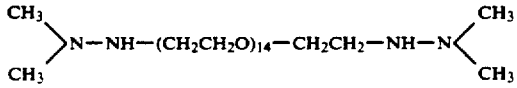

10-4

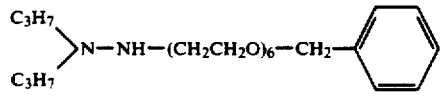

$R_1(R_2)N-T$ Formula 11 wherein $R_1$ and $R_2$ represent each a hydrogen atom, an alkyl group, an alkenyl group, an alkenyl group, an aryl group or a heterocyclic group, provided, $R_1$, $R_2$ and T are allowed to form a ring; and T represents a group containing at lest one of the groups represented by the foregoing group 2;

R represents a hydrogen atom or an alkyl group; X represents O, S or NH group; Y represents a hydrogen atom or OH group; and n is an integer of not less than 2, provided, when R represents a hydrogen atom, X represents S or NH group; among the groups represented by $R_1$ and $R_2$, the alkyl group, alkenyl group, alkynyl group, aryl group and heterocyclic group include the same groups represented by $R_1$, $R_2$ and $R_3$ denoted in the foregoing formula 3; the rings formed by $R_1$, $R_2$ or T include the heterocyclic groups such as those of piperidine, morpholine, quinuclidine or pyrazolidine; and the alkyl groups represented by R include, preferably, a methyl The typical examples of the preferable compounds represented by formula 11 may be given as follows.

Compound 11-1

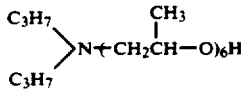

11-2

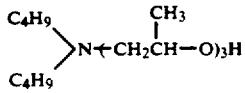

11-3

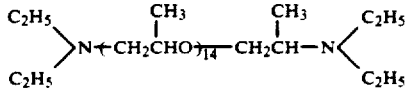

-continued 11-4

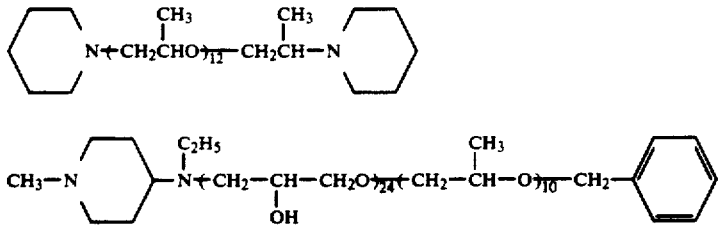

$R_1(R_2)N—G$ Formula 12 wherein $R_1$ and $R_2$ represent each a hydrogen atom, an alkyl group, an alkenyl group, an alkynyl group, an aryl group or a heterocyclic group, provided, $R_1$, $R_2$ and G are allowed to form a ring; G contains at least one of the same groups $$\text{+}CH_2CH_2O\text{+}_n$$

as in E denoted in the foregoing formula 6 and at least two of the substituents each having a hydrophobic substituent constant $\pi$ within the range of —0.5 to —1.0, or it contains at least one of the substituents each having a $\pi$ value less than —1.0; n is an integer of not less than 2; among the groups represented by $R_1$ and $R_2$, the alkyl group, alkenyl group, alkynyl group, aryl group and heterocyclic group include the same groups represented by $R_1$, $R_2$ and $R_3$ denoted in the foregoing formula 3; and the rings formed by $R_1$, $R_2$ and G include, for example, the rings such as those of piperidine, quinuclidine or morpholine;

The above-mentioned hydrophobic substituent constant x is detailed in 'The structural Activity Correlation of Medical Substances' pp.79~103, Nanko-Do Publishing Co., 1979.

The substituents each having a $\pi$ value within the range of −0.5 to −1.0 include, for example, —CN, —OH, $—OSO_2CH_3$, $—OCOCH_3$, $—SO_2N(CH_3)_2$, $—NHCOCH_3$ and the following group 3.

Group 3

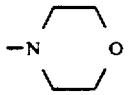

The substituents each having a $\pi$ value less than −1.0 include, for example, $—CONH_2$, —CONHOH, $—CONHCH_3$, $—NH_2$, $—NHCONH_2$, $—NHCSNH_2—$, $—NHSO_2CH_3$, $—N^+(CH_3)_3$, $—O^-$, $—OCONH_2$, $—SO_3—$, $—SO_2NH_2$, $—SOCH_3$, $—SO_2CH_3$ and $—COO^-$.

The typical examples of the preferable compounds represented by formula 12 may be given as follows.

Compound 12-1

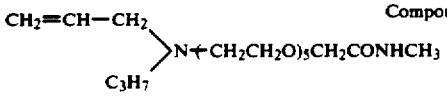

12-2

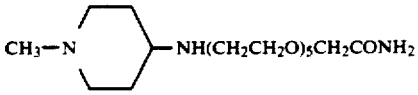

-continued 12-3

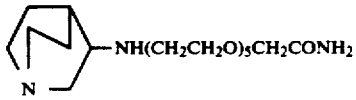

The compounds represented by formulas 1 and 2, which are the hydrazine derivatives, and the nucleation-promoting compounds, each applicable to the invention, may be added in an amount within the range of, desirably, $5\times10^{-7}$ to $5\times10^{-1}$ mols/Ag mol and, preferably, $5\times10^{-6}$ to $1\times10^{-2}$ mols/Ag mol.

In the invention, the typical methods of forming an conducting layers include, for example, a method of forming the layers by making use of water-soluble conducting polymer particles, hydrophobic polymer particles and a hardener and a method of forming them by making use of a metal oxide. The details thereof are described in, for example, Japanese Patent Application No. 2-226971/1990.

The water-soluble conducting polymers of the invention include, for example, the polymers each having at least one of the electroconductive groups selected from the group consisting of a sulfonic acid group, a sulfuric acid ester group, a quaternary ammonium salt and a carboxyl group. The electroconductive groups are each required to have not less than 5% by weight per one polymer molecule. The water-soluble conducting polymer are each allowed to contain a hydroxy group, an amino group, an epoxy group, an aziridine group, an active methylene group, a sulfinic acid group, an aldehyde group or a vinylsulfone group.

The molecular weight of each of the polymers is to be within the range of 3,000 to 100,000 and, preferably, 3,500 to 50,000.

The typical examples of the water-soluble electroconductive polymer compounds each applicable to the invention will be given below. It is, however, to be understood that the examples thereof shall not be limited thereto.

Compound A-1

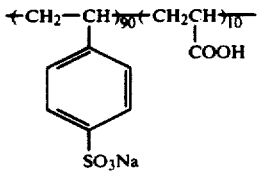

Mn = 10000

-continued

A-2

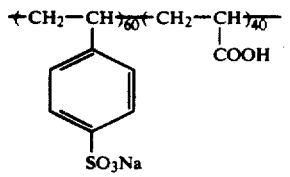

Mn = 7000

A-3

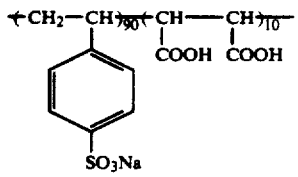

Mn = 5000

A-4

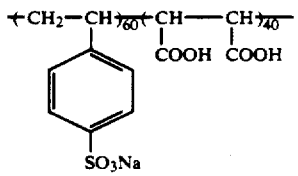

Mn = 5000

In the above-given compounds A-1 through A-4, Mn represents an average molecular weight, (that is a number average molecular weight in this patent specification), which is a value measured in GPC converted in terms of polyethylene glycol.

The water-soluble conducting polymers applicable to the invention are to be added in an amount within the range of 50 mg/m$^2$ to 2000 mg/m$^2$ and, preferably, 100 mg/m$^2$ to 1000 mg/m$^2$.

In a water-soluble electrically conductive polymer layer of the invention, the hydrophobic polymer particles contained therein are comprised of the form of so-called latex which is substantially insoluble to water. The hydrophobic polymers can be obtained in the polymerization of a monomers selected from the group consisting of a styrene, derivative thereof, alkyl acrylate, alkyl methacrylate, olefin derivative, halogenated ethylene derivative, vinyl ester derivative and acryl nitrile, or any combinations thereof. The hydrophobic polymers contain at least one of a styrene derivative monomer, alkyl acrylate monomer or alkyl methacrylate monomer in an amount of, desirably, at least 30 mol % and, preferably, not less than 50 mol %.

The hydrophobic polymers latex of the invention are preferably comprised of a monomer having a amido group or polyalkyleneoxide group.

The monomers each having an amido group, which are to be contained in the latexes of the invention, are to be preferably represented by the following formula 13.

Formula 13

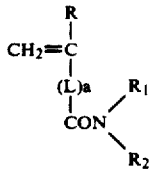

wherein R represents a hydrogen atom or a lower alkyl group having 1 to 4 carbon atoms; L represents a divalent group; a is an integer of 0 or 1; and $R_1$ and $R_2$ represent each a hydrogen atom or a lower alkyl group having 1 to 6 carbon atoms.

The typical examples of the monomers of the invention will be given below.

Monomer 1

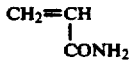

Monomer 2

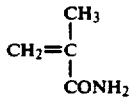

Monomer 3

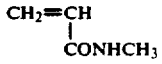

Monomer 4

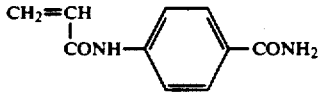

Monomer 5

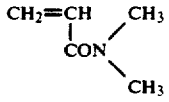

There are two methods for making hydrophobic polymers to be a latex; namely, a method in which the hydrophobic polymers are polymerized upon emulsifying them and the other method in which solid polymers are finely dispersed in a low-boiling solvent and, then, the solvent is distilled away. From the viewpoint that fine and uniform particle sizes thereof can be obtained, the former method is preferable. The molecular weight of hydrophobic polymers may be not less than 3000 and, there is almost no transparency difference produced by any variations of the molecular weights of the polymers.

The methods for introducing a polyalkylene oxide chain into a hydrophobic polymer latex of the invention include, preferably, a method in which monomers each having a polyalkylene oxide chain are to be copolymerized together. The above-mentioned monomers include, preferably, those represented by the following formula 14.

Formula 14

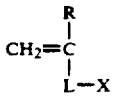

wherein R represents a hydrogen atom, a halogen atom, a lower alkyl group, or —$CH_2$—L—X in which L represents —COO—, —CON($R_1$)— or an aryl group having 6 to 12 carbon atoms; $R_1$ represents a hydrogen atom, an aryl group, a lower alkyl group or X; and X represents the following group 4.

$$-(R_2-O)_n-R_3$$ Group 4 wherein $R_2$ represents at least one selected from the group consisting of $-CH_2CH_2-$, $-CH_2CH(CH_3)$, $-CH_2CH_2CH_2-$, $-CH_2CH(CH_3)CH_2-$, $-CH_2CH_2CH_2CH_2-$ and $-CH_2CH(OH)CH_2-$; $R_3$ represents a hydrogen atom, a lower alkyl group, an alkylsulfonic acid or the salts thereof, or an alkylcarboxylic acid or the salts thereof; and n is an integer within the range of not less than 2 to not more than 70.

Next, the typical examples of the above-mentioned monomers are given below.

Monomer M-1

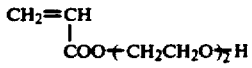

M-2

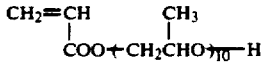

M-3

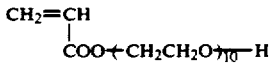

M-4

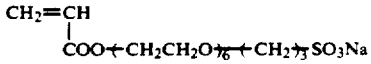

The typical examples of the latexes of the invention are given below.

Latex B-1

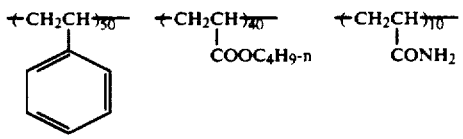

-continued

B-2

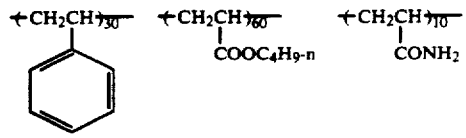

B-3

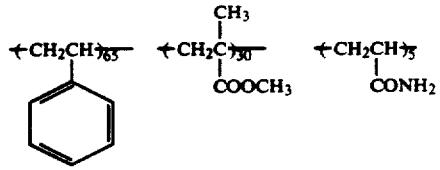

B-4

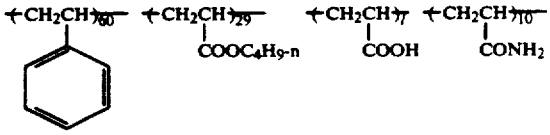

B-5

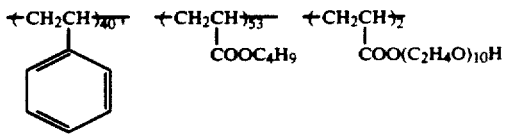

B-6

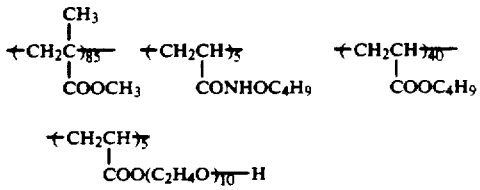

Epoxy compounds are preferable as a hardener to be employed in the water-soluble, electrically conductive layer. The preferable epoxy compounds include, for example, those containing a hydroxy group or an ether linkage.

The typical examples of the epoxy compounds of the invention are given below.

Epoxy compound E-1

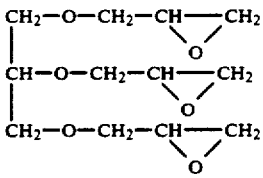

E-2

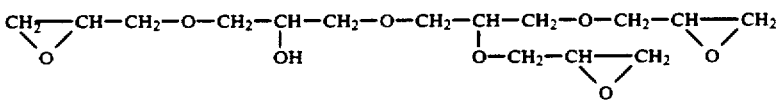

E-3

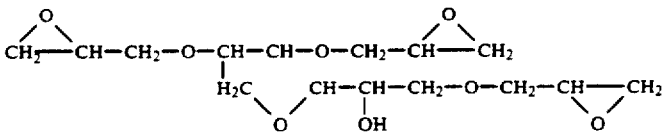

-continued

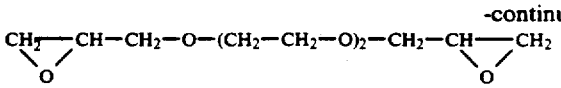

E-4

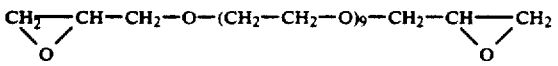

E-5

The amount of the hydrophobic polymer latex to be added into an antistatic layer is to be within the range of, desirably, 10 mg/m$^2$ to 1000 mg/m$^2$ and, preferably, 100 mg/m$^2$ to 500 mg/m$^2$; the amount of the water-soluble electroconductive polymer to be added thereinto is to be within the range of, desirably, 50 mg/m$^2$ to 2000 mg/m$^2$ and, preferably, 100 mg/m$^2$ to 1000 mg/m$^2$; and the amount of the epoxy type compound to be added thereinto is to be within the range of, desirably, 10 mg/m$^2$ to 500 mg/m$^2$ and, preferably, 50 mg/m$^2$ to 300 mg/m$^2$, respectively.

The above-mentioned antistatic layers are allowed to be applied with a dispersant. The dispersants applicable thereto include, for example, a nonionic surfactant and, among them, a polyalkylene oxide compound can preferably be used.

In the invention, the above-mentioned polyalkylene oxide compound applicable thereto is that containing at least not less than two or at most not more than 500 polyalkylene oxide chains in the molecules of the compound. The polyalkylene oxide compounds can be synthesized either by making a condensation reaction with a compound having an active hydrogen atom or by condensating such a polyol as polypropylene glycol or polyoxy tetramethylene copolymer with an aliphatic mercaptan, organic amine, ethylene oxide or propylene oxide.

The above-mentioned polyalkylene oxide compounds may also be the so-called block copolymers in which the molecular contains not less than two polyalkylene oxide chains separately, but not a single chain. In this instance, the total polymerization degree of the polyalkylene oxide is preferably not more than 100.

The typical examples of the above-mentioned polyalkylene oxide compounds which can freely be used in the invention will be given below.

[Exemplified compounds]

| | | |
|---|---|---|
| [Ao-1] | $HO(CH_2CH_2O)_nH$ | [n = 4] |
| [Ao-2] | $HO(CH_2CH_2O)_nH$ | [n = 35] |
| [Ao-3] | $HO(CH_2CH_2O)_nH$ | [n = 135] |
| [Ao-4] | $HO(CH_2CH_2O)_nH$ | [n = 225] |
| [Ao-5] | $HO(CH_2CH_2O)_nH$ | [n = 450] |
| [Ao-6] | $n\text{-}C_4H_2O(CH_2CH_2O)_lH$ | [l = 20] |
| [Ao-7] | $n\text{-}C_8H_{17}O(CH_2CH_2O)_lH$ | [l = 30] |
| [Ao-8] | $n\text{-}C_{12}H_{25}O(CH_2CH_2O)_lH$ | [l = 30] |
| [Ao-9] | 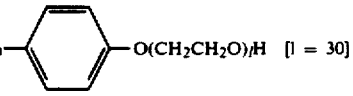 | [l = 30] |

Next, a method for forming an conducting layer with the use of a metal oxide will be detailed below.

The desirable metal oxides include crystalline metal oxide particles. Among them, the preferable metal oxides include, particularly, those containing an oxygen defect and those containing a small amount of heteroatoms capable of producing donors to a metal oxide used, because they are generally high in electroconductivity. In particular, the latter, which are metal oxides each containing a small amount of heteroatoms capable of producing doners to a metal oxide used, are preferable because any silver halide emulsion cannot be fogged.

The examples of the metal oxides include, desirably, ZnO, $TiO_2$, $SnO_2$, $Al_2O_3$, $In_2O_3$, $SiO_2$, MgO, BaO, $MoO_3$ and $V_2O_5$ and the compound oxides thereof and, among them, $ZnO_2$, $TiO_2$, $SnO_2$ and $V_2O_5$ are preferable.

In the examples of the the metal oxides containing heteroatoms, it is effective to add, for example, Sb or the like into SnO, or Nb or Ta into $TiO_2$. The amount of the heteroatoms to be added is to be within the range of, desirably, 0.01 to 30 mol % and, preferably, 0.1 to 10 mol %.

The metal oxide particles applicable to the invention have electroconductivity. The volumetric resistivity thereof is to be not more than $10^7\Omega$cm and, preferably, not more than $10^5\Omega$cm.

The above-mentioned oxides are detailed in JP OPI Publication Nos. 56-143431/1981, 56-120519/1981 and 58-62647/1983.

The metal oxide particles are used upon dispersing or dissolving in a binder.

In order to make effectively use of the metal oxides and to lower the resistance of an electroconductive layer, it is desirable to make the volumetric metal oxide content higher in the electroconductive layer. It is, however, required to use a binder in an amount of the order of at least 5% so that the layer strength can be satisfactory. It is, therefore, desirable that the volumetric percentage of the metal oxides is to be within the range of 5 to 95%.

The metal oxides is to be used in an amount within the range of, desirably, 0.05 to 10 g/m$^2$ and, preferably, 0.01 to 5 g/m$^2$. When this is the case, an antistatic property of the metal oxides can be displayed.

In the invention, the conducting layer is interposed between a silver halide emulsion layer and a support, or it is arranged to the support side opposite to the emulsion layer. In other words, the conducting layer may also be arranged to the light sensitive emulsion side of a transparent support, or it may further be arranged to the transparent support side opposite to the light sensitive emulsion side.

The above-mentioned electroconductive layer is formed by coating it over the transparent support.

Any one of the transparent supports for photographic use can be used therein and, among these supports, the preferable supports are made of polyethylene terephthalate or cellulose triacetate through which not less than 90% of visible rays of light can be transmitted.

The above-mentioned transparent supports are prepared in any methods well known in the skilled in the art. If occasion requires, the supports may also be blue-tinted by adding a dye a little.

A support may also be coated thereon with a sublayer containing latex polymer, after the support is subject to a corona-discharge treatment. In the above-mentioned corona-discharge treatment, an energy within the range of 1 mW to 1 $KW/m^2/min$ is preferably applied thereto. It is further preferable that a corona-discharge treatment is carried out again after coating the latex sublayer and before coating the electroconductive layer.

In the photographic light sensitive materials of the invention, the amounts of the hydrazine derivatives represented by the foregoing formula 1 or 2 and the nucleation acceleration compounds represented by the foregoing formulas 3 through 12, each of which are to be added thereinto, are to be within the range of, desirably, $5\times10^{-7}$ mols to $5\times10^{-1}$ mols and, preferably, $5\times10^{-6}$ mols to $1\times10^{-2}$ mols per mol of the silver halides contained in a subject photographic light sensitive material.

In the silver halide photographic light sensitive materials of the invention, at least one silver halide emulsion layer may sometimes be arranged to one side of the support thereof, or at least one of them may be arranged to each side of the support. Further, the above-mentioned silver halide emulsion layer may be coated directly over the support, or it may be coated thereover through the other layers including, for example, a hydrophilic colloidal layer not containing any silver halide emulsion and, in addition, a protective layer may further be coated over the silver halide emulsion layer.

The silver halide emulsion layer may also be coated by separating it into a plurality of silver halide emulsion layers each having different speeds, such as a high-speed silver halide emulsion layer and a low-speed silver halide emulsion layer. In this instance, an interlayer may be interposed between the silver halide emulsion layers. It is also allowed to interpose non-light-sensitive hydrophilic colloidal layers such as an interlayer, a protective layer, an antihalation layer and a backing layer between the silver halide emulsion layer and a protective layer.

Next, the silver halides applicable to the silver halide photographic light sensitive materials of the invention will be detailed below. Such a silver halide as mentioned above is silver chloroiodobromide or silver iodobromide each containing silver iodide in a proportion of not more than 4 mol % and, preferably, in a proportion of not more than 3 mol %. The silver halide grains applicable thereto have an average grain size within the range of, desirably, 0.05 to 0.5 μm and, preferably, 0.10 to 0.40 μm.

The silver halide grains applicable to the invention may have any grain-size distributions. However, the monodispersion degrees thereof, which will be defined as follows, are to be controlled within the range of, desirably, 1 to 30 and, preferably, 5 to 20.

The term, 'monodispersion degree', is hereby defined as a value 100 times a quotinent obtained by dividing the standard deviation of a grain size by an average grain-size. For convenience' sake, the grain-sizes of silver halide grains are expressed in terms of an edge length in the case of cubic grains and expressed in terms of the square root of a projective area in the cases of the other grains (such as an octahedral and tetradecahedral grains).

When embodying the invention, The silver halide grains applicable thereto include, for example, those of the type having at least two-layered or multilayered structure, such as silver iodobromide grains having a core comprising silver iodobromide and a shell comprising silver bromide. In this instance, an iodide in a proportion not more than 5 mol % may be contained in any desired layers.

In the silver halide grains applicable to the silver halide emulsions of the invention, metal ions may be added therein by making use of at least one selected from the group consisting of a cadmium salt, a zinc salt, a lead salt, a thallium salt, an iridium salt (and the complexes containing the iridium salts), a rhodium salt (and the complexes containing the rhodium salts) and an iron salt (and the complexes containing the iron salts) so that the above-mentioned metal atoms can be contained in the insides and/or surfaces of the grains, or a reduction-sensitization nucleus can be provided to each of the insides and/or surfaces of the grains when putting the silver halide grains in a suitable reducible atmosphere.

The silver halide grains can also be sensitized with a variety of chemical sensitizers.

The silver halide emulsions applicable to the invention can further be stabilized or inhibited themselves from being fogged by making use of a mercapto compound (such as 1-phenyl-5-mercaptotetrazole and 2-mercaptobenzthiazole), a benzotriazole compound (such as 5-bromobenzotriazole and 5-methylbenzotriazole), a benzimidazole compound (such as 6-nitrobenzimidazole) and an indazole compound (such as 5-nitroindazole).

For the purposes of increasing a sensitivity, contrast or development acceleration, the compounds given in Research Disclosure No. 17463, XXI-B to D can be added into a light-sensitive silver halide emulsion layer or the layers adjacent thereto.

Further, a sensitizing dye, a plasticizer, an antistatic agent, a surfactant and a hardener may be added into the silver halide emulsions applicable to the invention.

When adding the compounds represented by the formulas relating to the invention into a hydrophilic colloidal layer, gelatin is suitable for the binder applicable to the above-mentioned hydrophilic colloidal layers and, however, the other hydrophilic colloids than gelatin can also be applicable. The above-mentioned hydrophilic binders are each coated preferably onto the both sides of a support, respectively, in an amount of not more than 10 $g/m^2$.

The developers applicable to the invention are characterized in that those having a pH of lower than pH 11 can be used. If required, the above-mentioned developer may freely be added with an inorganic or organic development inhibitor, a metal ion scavenger, a development accelerator, a surfactant, a hardener and an ionic strength controller.

Into the developers applicable to the invention, a glycol may be contained so as to serve as an organic solvent, besides the compounds relating to the invention.

Now, the invention will be more detailed with reference to the following examples.

EXAMPLE 1

A subbed polyethylene terephthalate film support was subjected to a corona-discharge treatment with an energy of $8W/(m^2.min)$ and was then coated thereon with the antistatic solution having the following composition by making use of a roll-fit coating pan and an air-knife at a coating speed of 30 m/min so as to coat in the following coated amount.

Preparation of a Support Having an Conducting Layer

A subbed 100 μm-thick polyethylene terephthalate film support was subjected to a corona-discharge treatment and was then coated thereon with the antistatic agent solution having the following composition by making use of a roll-fit coating pan and an air-knife at a coating speed of 70 m/min so as to coat in the following coated amount.

| | |
|---|---|
| Water-soluble conducting polymer A (See Table 1) | 0.6 g/m$^2$ |
| Hydrophobic polymer particle B-5 | 0.4 g/m$^2$ |
| Hardener E-4 | 0.2 g/m$^2$ |

The resulting coated support was dried at 90° C. for 2 minutes and was then heat-treated at 140° C. for 90 seconds. The resulting supports each coated thereon with the conducting layer were prepared as shown in Table 1.

(Preparation of silver halide photographic emulsion A)

A silver iodobromide emulsion (having a silver iodide content of 2 mol % per mol of silver) was prepared in a double-jet precipitation method. When keeping the mixation, $K_2IrCl_6$ was added in a proportion of $8\times10^{-7}$ mols per mol of silver. The resulting emulsion was an emulsion comprising cubic monodispersed grains having an average grain-size of 0.24 μm (having a variation coefficient of 9%).

Into the resulting emulsion, an aqueous 1% potassium iodide solution in an amount of 6.5 cc per mol of silver and then a modified gelatin (that was Exemplified compound G-8 given in Japanese Patent Application No. 1-180787/1989) were added. The resulting mixture was washed and then desalted in the same manner as in Example 1 given in Japanese Patent Application No. 1-180787/1989. The resulting pAg thereof was 8.0 at 40° C. after desalted When making another dispersion, the mixture of compounds [A], [B] and [C] was added therein to serve as an antibacterial agent.

| | |
|---|---|
| Formula (1) (Composition of the silver halide emulsion layer) | |
| Gelatin | 2.0 g/m$^2$ |
| Silver amount of silver halide emulsion A | 3.2 g/m$^2$ |
| Sensitizing dye: S-1 | 8 mg/m$^2$ |
| Sensitizing dye: S-2 | 0.2 mg/m$^2$ |
| Stabilizer: 4-methyl-6-hydroxy-1,3,3a,7-tetrazaindene | 30 mg/m$^2$ |
| Antifoggant: Adenine | 10 mg/m$^2$ |
| Surfactant: Saponin | 0.1 g/m$^2$ |
| Surfactant: Su-1 | 8 mg/m$^2$ |
| Hydrazine derivative relating to the invention and a nucleation promoting agent | Amount shown in Table 1 |
| Latex polymer (m:n = 50:50) | 1 g/m$^2$ |
| Polyethylene glycol (having a molecular weight of 4000) | 0.1 g/m$^2$ |
| Hardener: H-1 | 60 mg/m$^2$ |
| Formula (2) (Composition of the emulsion-protective layer) | |
| Gelatin | 0.9 g/m$^2$ |
| Surfactant: Su-2 | 10 g/m$^2$ |
| Surfactant: Su-3 | 10 mg/m$^2$ |
| Matting agent: Silica having an average particle size of 3.5 μm | 3 mg/m$^2$ |
| Layer hardener: Formalin | 30 mg/m$^2$ |
| Formula (3) (Composition of the backing layer) | |
| Compound (a) | 30 mg/m$^2$ |
| Compound (b) | 75 mg/m$^2$ |
| Compound (c) | 30 mg/m$^2$ |
| Gelatin | 2.4 g/m$^2$ |
| Surfactant: Saponin | 0.1 g/m$^2$ |
| Surfactant: Su-1 | 6 mg/m$^2$ |
| Hardener: E-4 | 55 mg/m$^2$ |
| Formula (4) [Composition of the backing protective layer] | |
| Gelatin | 1.4 g/m$^2$ |
| Matting agent: polymethyl methacrylate having an average particle size within the range of 3.0 to 5.0 μm | 15 mg/m$^2$ |
| Surfactant: Su-2 | 10 mg/m$^2$ |
| Sodium chloride | 80 mg/m$^2$ |
| Hardener: Glyoxal | 25 mg/m$^2$ |
| Hardener: H-1 | 35 mg/m$^2$ |

Compounds [A] + [B] + [C]

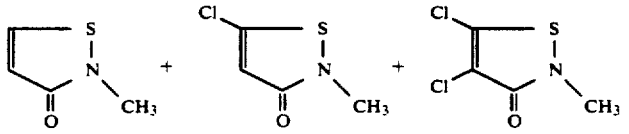

-continued
Sensitizing dye S-1
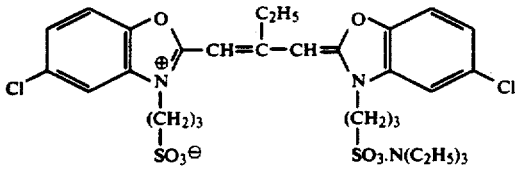
Sensitizing dye S-2
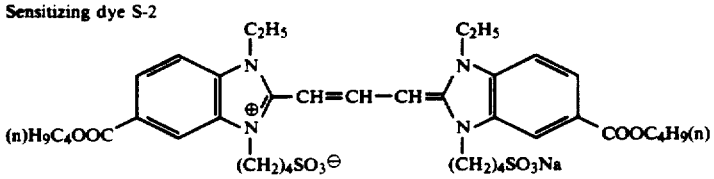
Surfactant Su-1
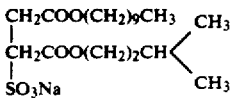
Surfactant Su-2
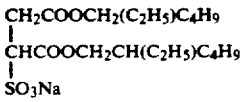
Surfactant Su-3
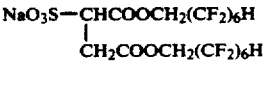
Latex polymer
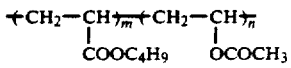
Hardener H-1
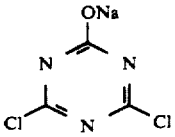
Backing layer compound
(a)
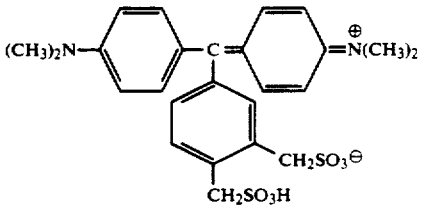
(b)
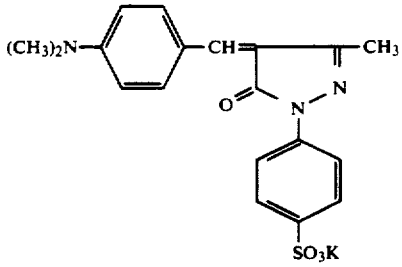
(c)
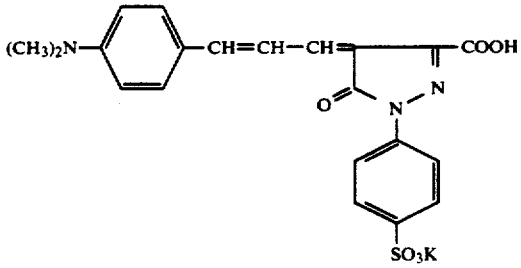

Preparation of the Samples

Samples No. 1 through No. 19 were each prepared in the following manner, respectively.

First, onto one side of a support having the foregoing antistatic layer, a corona-discharge treatment was applied with an energy of 15W/(m$^2$.min) and was then coated thereon with a silver halide emulsion layer having the following composition (1) so as to coat a gelatin amount of 2.0 g/m$^2$ and an silver amount of 3.2 g/m$^2$ and, further thereon, an protective layer having the following composition (2) was coated so as to have a gelatin amount of 1.0 g/m$^2$.

Second, onto the other side of the support, a corona-discharge treatment was applied with an energy of 15W/(m$^2$.min) and was then coated thereon with a backing layer having the following composition (3) so as to coat a gelatin amount of 2.4 g/m$^2$ and an iron amount of 3.2 g/m$^2$ and, further thereon, a backing protective layer having the following composition (4) was coated so as to have a gelatin amount of 1 g/m$^2$ After each of the resulting samples was brought into close contact with a step-wedge and was then exposed to 3200K tungsten light for 5 seconds, each of the exposed samples was processed under the following conditions through a rapid processing automatic processor containing a developer and a fixer each having the following compositions.

| | |
|---|---|
| Composition of the developer | |
| Sodium ethylenediamine tetraacetate | 1 g |
| Sodium sulfite | 60 g |
| Trisodium phosphate (12 hydrate) | 75 g |
| Hydroquinone | 22.5 g |
| Sodium hydroxide | 8 g |
| Sodium bromide | 3 g |
| 5-methyl benztriazole | 0.25 g |
| 1-phenyl-5-mercaptotetrazole | 0.08 g |
| Metol | 0.25 g |
| Add water to make | 1 liter |
| Adjust pH with sodium hydroxide to be | pH 10.4 |
| Composition of the fixer | |
| (Composition A) | |
| Ammoniumthiosulfate (in an aqueous 72.5% W/V solution) | 240 ml |
| Sodium sulfite | 17 g |
| Sodium acetate, trihydrate | 6.5 g |
| Boric acid | 6.0 g |
| Sodiumcitrate, dihydrate | 2.0 g |
| (Composition B) | |
| Pure water (i.e., ion-exchange water) | 17 ml |
| sulfuric acid (in an aqueous 50% W/V solution) | 4.7 g |
| Aluminum sulfate (in an aqueous solution having a reduced $Al_2O_3$ content of 8.1% W/V) | 26.5 g |

Before the fixer was going to be used, the above-given compositions A and B were dissolved in this order into 500 ml of water so as finish to be 1 liter. The pH of the finished fixer was adjusted to be 4.8 by making use of acetic acid.

| (Development conditions) | | |
|---|---|---|
| (Processing step) | (Temperature) | (Time) |
| Developing | 40° C. | 15 sec. |
| Fixing | 35° C. | 15 sec. |
| Washing | 30° C. | 10 sec. |
| Drying | 50° C. | 10 sec. |

Into the silver halide emulsion layer having the foregoing formula (1), the following compound (d) was added as a comparative compound to the hydrazine derivative relating to the invention added in the emulsion layer.

Compound (d)

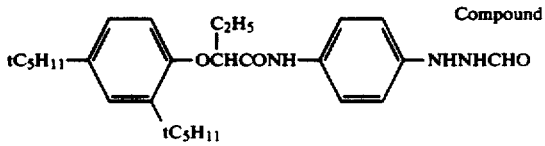

Each of the resulting developed samples was measured by Konica Digital Densitometer PDA-65. The sensitivity of each sample was expressed in terms of a sensitivity relative to that of Sample No. 1 at a density of 3.0 which was regarded as a value of 100, and the gamma of each sample was expressed in terms of a tangent obtained by the densities of 0.3 and 3.0. When a gamma value obtained thereby is lower than 6, the subject sample was not useful and, when it was within the range of not lower than 6 to lower than 10, the hard contrast property of the subject sample was not satisfactory. When the gamma value was not lower than 10, a ultrahigh contrast image could be provided, so that the sample could satisfactorily be put into practical use.

Evaluation of Pin-Hole Production

A halftone film was put on a mounting base and the corner edges of the halftone film were fixed with a transparent Scotch tape for plate-making use, and it was then exposed and processed. The evaluation of pin-hole production was carried out in the manner that the evaluation was graded as point 5 when no pin-hole was produced and as point 1 when the production thereof was most serious, respectively.

When the evaluation was graded as not higher than point 3, there raised a problem that the subject sample could not be put into practical use.

The results thereof are shown in Table 2 given below.

TABLE 1

| | Hydrazine derivative | | Nucleation promoting agent | | Conducting polymer | |
|---|---|---|---|---|---|---|
| No. | Compound | Amount added (Mol/mol Ag) | Compound | Amount added (Mol/mol Ag) | Compound | Amount added (Mol/mol Ag) |
| 1 | d | $2 \times 10^{-3}$ | — | — | — | — |
| 2 | d | $2 \times 10^{-3}$ | — | — | A-1 | 0.6 |
| 3 | d | $2 \times 10^{-3}$ | 5-3 | $1.5 \times 10^{-3}$ | — | — |
| 4 | d | $2 \times 10^{-3}$ | 5-3 | $1.5 \times 10^{-3}$ | A-1 | 0.6 |
| 5 | (1) | $2 \times 10^{-3}$ | — | — | — | — |
| 6 | (1) | $2 \times 10^{-3}$ | — | — | A-1 | 0.6 |
| 7 | (1) | $2 \times 10^{-3}$ | 5-3 | $1.5 \times 10^{-3}$ | — | — |
| 8 | (1) | $2 \times 10^{-3}$ | 5-3 | $1.5 \times 10^{-3}$ | A-1 | 0.6 |
| 9 | (1) | $2 \times 10^{-3}$ | 5-3 | $1.5 \times 10^{-3}$ | A-3 | 0.6 |
| 10 | (1) | $2 \times 10^{-3}$ | 1-3 | $1.5 \times 10^{-3}$ | A-1 | 0.6 |

TABLE 1-continued

| No. | Hydrazine derivative Compound | Hydrazine derivative Amount added (Mol/mol Ag) | Nucleation promoting agent Compound | Nucleation promoting agent Amount added (Mol/mol Ag) | Conducting polymer Compound | Conducting polymer Amount added (Mol/mol Ag) |
|---|---|---|---|---|---|---|
| 11 | (1) | $2 \times 10^{-3}$ | 1-3 | $1.5 \times 10^{-3}$ | A-3 | 0.6 |
| 12 | (8) | $2 \times 10^{-3}$ | 7-1 | $1.5 \times 10^{-3}$ | A-1 | 0.6 |
| 13 | (8) | $2 \times 10^{-3}$ | 7-1 | $1.5 \times 10^{-3}$ | A-3 | 0.6 |
| 14 | (8) | $2 \times 10^{-3}$ | 5-2 | $1.5 \times 10^{-3}$ | A-1 | 0.6 |
| 15 | (8) | $2 \times 10^{-3}$ | 5-2 | $1.5 \times 10^{-3}$ | A-3 | 0.6 |
| 16 | (5) | $2 \times 10^{-3}$ | 4-2 | $1.5 \times 10^{-3}$ | A-1 | 0.6 |
| 17 | (5) | $2 \times 10^{-3}$ | 4-2 | $1.5 \times 10^{-3}$ | A-3 | 0.6 |
| 18 | (5) | $2 \times 10^{-3}$ | 6-1 | $1.5 \times 10^{-3}$ | A-1 | 0.6 |
| 19 | (5) | $2 \times 10^{-3}$ | 6-1 | $1.5 \times 10^{-3}$ | A-3 | 0.6 |

TABLE 2

| Sample No. | Characteristics Sensitivity | Gamma | Pin-hole |
|---|---|---|---|
| 1 Comparison | 100 | 3.5 | 1 |
| 2 Comparison | 100 | 3.5 | 4 |
| 3 Comparison | 120 | 5.0 | 1 |
| 4 Comparison | 120 | 5.0 | 5 |
| 5 Comparison | 130 | 6.0 | 1 |
| 6 Comparison | 130 | 6.0 | 4 |
| 7 Comparison | 205 | 11.0 | 1 |
| 8 Invention | 205 | 11.0 | 4 |
| 9 Invention | 205 | 11.0 | 5 |
| 10 Invention | 210 | 11.0 | 5 |
| 11 Invention | 210 | 11.0 | 4 |
| 12 Invention | 210 | 11.0 | 5 |
| 13 Invention | 210 | 11.0 | 5 |
| 14 Invention | 205 | 11.0 | 5 |
| 15 Invention | 205 | 11.0 | 5 |
| 16 Invention | 210 | 11.0 | 4 |
| 17 Invention | 210 | 11.0 | 5 |
| 18 Invention | 210 | 11.0 | 5 |
| 19 Invention | 210 | 11.0 | 5 |

As is also obvious from Table 2, it could be proved that Samples No. 8 through No. 19 each relating to the invention were each high in contrast and less in pin-hole production, as compared to the comparative samples, when they were processed with a developer having a pH of lower than 11.

EXAMPLE 2

A 100 μm-thick subbed polyethylene terephthalate film support was corona-discharged and was the coated thereon with an electroconductive layer having the following composition.

| | |
|---|---|
| Gelatin | 35 mg/m$^2$ |
| $SnO_2$/Sb, (8/2) (having a particle size of 0.3 μm) | 250 mg/m$^2$ |

Compound (e)

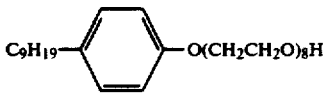

The conducting layer-coated support was dried up at 90° C. for 2 minutes and was then heat-treated at 140° C. for 90 seconds.

The samples were each prepared in quite the same manner as in Example 1, except that an emulsion layer, an protective layer, a backing layer and a back-protective layer were arranged thereto. When trying the tests of the resulting samples in the same manner as in Example 1, the equivalent results to those of Example 1 could be obtained.

EXAMPLE 3

Sample No. 21 was prepared in a similar manner to Sample 7 in Example 1 except that the hardener, E-4 was replaced by the following compound (f).

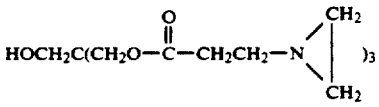

Compound (f)

Sample No. 22 through 30 were similarly prepared as shown in Table 3. Those samples were subjected to light-exposure, processed and evaluated in the same manner as in Example 1.

The results thereof are shown in Table 3.

TABLE 3

| Sample No. | Hardener | Conducting polymer Compound | Conducting polymer Amount* | Characteristics Sensitivity | Gamma | Pin-hole |
|---|---|---|---|---|---|---|
| 21 | f | — | — | 190 | 9.0 | 1 |
| 22 | — | A-1 | 0.6 | 185 | 10.0 | 1 |
| 23 | f | A-1 | 0.6 | 190 | 10.0 | 1 |
| 24 | f | A-5 | 0.6 | 190 | 10.0 | 1 |
| 25 | E-1 | A-1 | 0.6 | 210 | 11.0 | 5 |
| 26 | E-1 | A-3 | 0.6 | 205 | 11.0 | 4 |
| 27 | E-2 | A-1 | 0.6 | 205 | 11.0 | 5 |
| 28 | E-2 | A-5 | 0.6 | 210 | 11.0 | 5 |
| 29 | E-5 | A-1 | 0.6 | 210 | 11.0 | 5 |
| 30 | E-5 | A-5 | 0.6 | 205 | 11.0 | 5 |

*mol/mol AG

As can be seen from Table 3, Samples No. 25 through 30 each containing an epoxy compound as a hardener were less in pin-hole production as compared to Samples No. 21 through 24.

What is claimed is:

1. A silver halide photographic light sensitive material comprising a support having thereon hydrophilic colloidal layers including a silver halide emulsion layer, wherein said silver halide emulsion layer or a layer adjacent to said silver halide emulsion layer comprises a hydrazine compound represented by formula 1 or 2 and a nucleation-promoting compound selected from the group consisting of amine compounds and quaternary onium salts; an electrically conductive layer is provided between said silver halide emulsion layer and said support, or provided onto the opposite side of said support to said silver halide emulsion layer; and wherein said silver halide photographic material is imagewise exposed and subsequently developed with a developer having a pH value of less than 11, formula 1

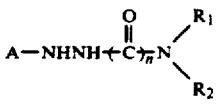

formula 2

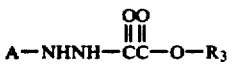

wherein A represents an aryl group or a heterocyclic group containing a sulfur atom or an oxygen atom; n is an integer of 2; $R_1$ and $R_2$ represent independently a hydrogen atom, an alkyl group, an alkenyl group, an alkynyl group, an aryl group, a saturated or unsaturated heterocyclic group, a hydroxy group, an alkoxy group, an alkenyloxy group, an alkynyloxy group, an aryloxy group or a heterocyclic-oxy group, provided that at least one of $R_1$ and $R_2$ represents an alkenyl group, an alkynyl group, a saturated heterocyclic group, a hydroxy group, an alkoxy, an alkenyloxy, an alkynyloxy group, an aryloxy group or heterocyclic-oxy group; $R_3$ represents an alkynyl group or a saturated heterocyclic group.

2. A photographic material of claim 1, wherein said nucleation-promoting compound is represented by the following formulas 3 through 12, $R_1—N(R_2)R_3$ Formula 3 wherein $R_1$, $R_2$ and $R_3$ represent each a hydrogen atom, an alkyl group, an alkenyl group, an alkynyl group, an aryl group or heterocyclic group, and $R_1$, $R_2$ and $R_3$ may combine to form a ring, Formula 4

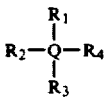

wherein Q represents a nitrogen atom or a phosphorus atom; $R_1$, $R_2$, $R_3$ and $R_4$ represent each those defined in $R_1$ to $R_3$ of formula 3, and $R_1$ to $R_4$ may combine each other to form a ring; $X^-$ represents an anion, $R_1(R_2)N—A—Y—R_3$ Formula 5 wherein $R_1$ and $R_2$ represent each an alkyl group, and $R_1$ and $R_2$ may combine each other to form a ring; $R_3$ represents an alkyl group, an aryl group or heterocyclic group; A represents an alkylene group; Y represents $—CONR_4—$, $—OCONR_4—$, $—NR_4CONR_4—$, $—NR_4COO—$, $—COO—$, $—OCO—$, $—CO—$, $—OCOO—$, $—NR_4CO—$, $—SO_2NR_4—$, $—NR_4SO_2—$, $—NR_4SO_2NR_4—$, $—SO_2—$, $—S—$, $—O—$, $—NR_4—$ or $—N=$, wherein $R_4$ represents a hydrogen atom or an alkyl group, $R_1(R_2)N—E$ Formula 6 wherein $R_1$ and $R_2$ represents each a hydrogen atom, an alkyl group, an alkenyl group, an alkynyl groupan aryl group or a heterocyclic group; E represents a group containing a group represented by the following formula, $(CH_2CH_2O)_n$ wherein n is an integer of not less than 2; and $R_1$, $R_2$ and E may combine each other to form a ring, $R_1(R_2)N—L—R_3$ Formula 7 wherein $R_1$, $R_2$ and $R_3$ represent each an alkyl group, an alkenyl group, an alkynyl group, an aryl group and a heterocyclic group, provided that at least one of $R_1$, $R_2$ and $R_3$ represents an alkenyl group or an alkynyl group, or at least one of $R_1$ and $R_2$ represents an aryl group or a heterocyclic group; L is a linking group; and $R_1$, $R_2$, L and $R_3$ may combine each other to form a ring, $R_1(R_2)N—N(R_3)—(L)_m—R_4$ Formula 8 wherein $R_1$, $R_2$ and $R_4$ represent each an alkyl groupan, an alkenyl group, an alkynyl group, an aryl group and a heterocyclic group; $R_3$ represents a hydrogen atom or substituent; L is a linking group; n is an integer of 0 or 1; and $R_1$, $R_2$, $R_3$ and $R_4$ may combine each other to form a ring, formula 9

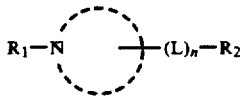

wherein $R_1$ represents a hydrogen atom, a substituent; $R_2$ represents an alkyl group, an alkenyl group, an alkynyl group, an aryl group or a heterocyclic group; L is a linking group; n is an integer of 0 or 1;

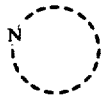

represents a nitrogen-containing heterocyclic ring, $R_1(R_2)N—N(R_3)—R_4$ Formula 10 wherein $R_1$ and $R_2$ represent each an alkyl group, an alkenyl group, an alkynyl group, an aryl group or a heterocyclic group; $R_3$ represents a hydrogen atom or substituent; $R_4$ represents a group containing a group represented by the following formulas, $(CH_2—CH—X)_n$ or $(CH_2—CH—CH_2—O)_n$ wherein R represents a hydrogen atom or an alkyl group; X represents a oxygen or sulfur atom, or NH group; Y represents a hydrogen atom or OH group; n is an integer of not less than 2; and $R_1$, $R_2$, $R_3$ and $R_4$ may combine each other to form a ring, $R_1(R_2)N—T$ Formula 11 wherein $R_1$ and $R_2$ represent each a hydrogen atom, an alkyl group, an alkenyl group, an alkynyl group, an aryl group and a heterocyclic group; T represents a group containing at least one of a group represented by the following formula, $(CH_2—CH—X)_n$ or $(CH''—CH—CH_2—O)_n$ wherein R represents a hydrogen atom or an alkyl group; X represents a oxygen or sulfur atom, or NH group; Y represent a hydrogen atom or OH group; n is an integer of not less than 2; and $R_1$, $R_2$ and T may combine each other to form a ring, $$R_1(R_2)N—G \qquad \text{Formula 12}$$

wherein $R_1$ and $R_2$ represent each a hydrogen atom, an alkyl group, an alkenyl group, an alkynyl group, an aryl group or a heterocyclic group, G represents a group containing at least one of the groups $(CH_2CH_2O)_n$ which are the same as defined in the formula 6 and at least two of substituent each having a hydrophobic substituent constant $\pi$ of $-1.0$ to $-0.5$ or at least one of substituent each having a $\pi$ value of less than $-1.0$; n is an integer of not less than 2; and $R_1$, $R_2$ and G may combine each other to form a ring.

3. A photographic material of claim 1, wherein said hydrazine compound represented by the formula 1 or 2 and said nucleation promoting compound are each contained in an amount of $5\times10^{-7}$ to $5\times10^{-1}$ mols per mol of silver halide.

4. A photographic material of claim 3, wherein said hydrazine compound and said nucleation-promoting compound are each contained in an amount of $5\times10^{-6}$ to $1\times10^{-2}$ mols per mol of silver halide.

5. A photographic material of claim 1, wherein said electrically conductive layer comprises a water-soluble, electrically conductive polymer, a hydrophobic polymer and a hardener of an epoxy compound capable of hardening said conductive layer.

6. A photographic material of claim 5, wherein said water-soluble, electrically conductive polymer is a polymer containing a group selected from a sulfonic acid group, a sulfuric acid ester group, a quaternary ammonium and a carboxyl group.

7. A photographic material of claim 5, wherein said hydrophobic polymer comprises at least one of a styrene monomer, an alkyl acrylate monomer and an alkyl methacrylate monomer.

8. A photographic material of claim 1, wherein said electrically conductive layer comprises a metal oxide.

9. A photographic material of claim 8, wherein said metal oxide is selected from the group consisting of $ZnO_2$, $TiO_2$, $SnO_2$, $Al_2O_3$, $In_2O_3$, $SiO_2$, MgO, BaO, $MoO_3$ and $V_2O_5$.

* * * * *

UNITED STATES PATENT AND TRADEMARK OFFICE

CERTIFICATE OF CORRECTION

PATENT NO. : 5,244,773

DATED : September 14, 1993

INVENTOR(S) : Yasuhiko Muramatsu et al.

It is certified that error appears in the above-indentified patent and that said Letters Patent is hereby corrected as shown below:

Claim 2, column 31, line 53 change "—NR-" to ——$NR_4$---.

Claim 2, column 31, line 54 change "$_4$COO—," TO --COO—,

Claim 2, column 31, line 55 change "—NR-" to ——$NR_4$---.

Claim 2, column 31, line 56 change "$_4SO_2NR_4$—," to --$SO_2NR_4$—,

Claim 2, column 31, line 63 change "groupan" to --group,--.

Claim 2, column 32, line 17 change "groupan" to --group,--.

Claim 2, column 32, line 35 change

" 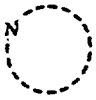 " to -- 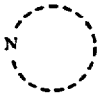 --.

UNITED STATES PATENT AND TRADEMARK OFFICE

CERTIFICATE OF CORRECTION

PATENT NO. : 5,244,773

DATED : September 14, 1993

INVENTOR(S) : Yasuhiko Muramatsu et al.

It is certified that error appears in the above-indentified patent and that said Letters Patent is hereby corrected as shown below:

Claim 2, column 33, line 1 change "Y represent to --Y repersents--.

Claim 3, column 33, line 19 change "nucleation promoting" to --nucleation-promoting--.

Signed and Sealed this

Sixteenth Day of May, 1995

Bruce Lehman

*Attest:*

BRUCE LEHMAN

*Attesting Officer*

*Commissioner of Patents and Trademarks*